US006778095B2

(12) United States Patent
Lo

(10) Patent No.: US 6,778,095 B2
(45) Date of Patent: Aug. 17, 2004

(54) VARIABLE LIGHT SOURCE DEVICE FOR POINTER-TYPE METER

(76) Inventor: Jui-Yang Lo, No. 2, Alley 27, Lane 143, Yuanshan Rd., Junghe, Taipei Hsien (TW)

( * ) Notice: Subject to any disclaimer, the term of this patent is extended or adjusted under 35 U.S.C. 154(b) by 16 days.

(21) Appl. No.: 10/271,739

(22) Filed: Oct. 17, 2002

(65) Prior Publication Data

US 2004/0075576 A1 Apr. 22, 2004

(51) Int. Cl.[7] ..... G08B 5/36

(52) U.S. Cl. ..... 340/815.78; 340/815.65; 340/438; 116/47

(58) Field of Search ..... 340/815.78, 815.4, 340/815.65, 815.66, 815.69, 815.73, 438, 441, 449, 450, 450.2, 450.3; 116/28 R, 47, 62.1; 362/23, 29

(56) References Cited

U.S. PATENT DOCUMENTS 5,797,345 A * 8/1998 Evans et al. ..... 116/286
5,815,072 A * 9/1998 Yamanaka et al. ..... 340/461
6,025,820 A * 2/2000 Salmon et al. ..... 345/75.1
6,441,726 B1 * 8/2002 Voto et al. ..... 340/438
6,561,123 B2 * 5/2003 Kallinke et al. ..... 116/288

* cited by examiner

*Primary Examiner*—Toan N. Pham
(74) *Attorney, Agent, or Firm*—Rosenberg, Klein & Lee

(57) ABSTRACT

A variable light source device useful for a pointer-type meter comprises essentially a microprocessor, a memory, a electronically controlled circuit, and a RGB luminescent light source set, characterized in that it takes advantage of an electronically controlled circuit to drive a RGB luminescent element in a manner of synchronically mixed lighting, and, by means of controlling programmatically by said microprocessor, projective light sources of different color can be changed as the pointer reaching the value set in the meter such that, by virtue of the changing projective light source, the user can notice immediately various warning signals to avoid dangerous event.

4 Claims, 5 Drawing Sheets

VARIABLE LIGHT SOURCE DEVICE FOR POINTER-TYPE METER

BACKGROUND OF THE INVENTION

1. Field of the Invention

The invention relates to a variable light source device useful for a pointer-type meter, and particular, to a projecting light source being capable of changing color in correspondence with the movement of the pointer such that the user can notice various warning signals instantly.

2. Description of the Prior Art

Most conventional pointer-type meters provide their users information by scoring on the panel and indicating by means of a pointer. Further, in accordance with the observation demand of the user, various meters usually have special indications at a specific area on their panel for informing the user any abnormality or condition needing notice immediately as happened. For example, as illustrated in FIG. 1, a schematic view of the panel on a conventional water thermometer, the temperature scale thereof spans over 40~120° C. However, as the vehicle moves, the normal value is 80~100° C. Thus, if the pointer does not indicate the normal region, whether too high or too low, there may be abnormal condition that the user should take precaution. As the driver is always too much involved or lack of experience or knowledge to judge that information, the dangerous event might happen at any time.

Currently, a variety of meters are provided for used in vehicles, such as, for example, speed meter, tachometer, oil meter, water thermometer, oil temperature meter, oil gauge, voltmeter, and the like. These often confuse the driver and make the driver difficult to remember the normal range of each type of these meters. As a result, in case of a abnormal condition that the user does not notice, the vehicle will be in a dangerous state to cause inconvenience to the user.

Accordingly, the conventional prior art has many disadvantages and need to be improved.

In view of the various disadvantage associated with the use of the conventional meters, the inventor had tried to improve and, after studying intensively for many years, found successfully the variable light source device useful for a pointer-type meter according to the invention.

SUMMARY OF THE INVENTION

Accordingly, one object of the invention is to provide a variable light source device useful for a pointer-type meter by means of an electronically controlled circuit to drive a RGB luminescent element in a manner of synchronically mixed lighting, and by means of controlling programmatically by a microprocessor, projective light sources of different color can be changed according to the value set in the meter such that, by virtue of the changing projective light source, the user can notice various warning signal to avoid dangerous event.

Another object of the invention is to provide a variable light source device useful for a pointer-type meter, characterized that it can be provided on various pointer-type meter such as speed meter, tachometer, oil meter, water thermometer, oil temperature meter, oil gauge, voltmeter, and the like.

Still another object of the invention is to provide a variable light source device useful for a pointer-type meter, characterized in that said variable light source has many different colors and can be set in accordance with the user's demand.

Yet still another object of the invention is to provide a variable light source device useful for a pointer-type meter, characterized in that said device is compact such that it can be provided inside and/or outside the housing of the meter as desired.

The variable light source device useful for a pointer-type meter that can fulfill the above-mentioned objects comprises essentially:

a microprocessor, provided between an electronically controlled circuit and a memory for receiving the displacement signal of the pointer and for outputting the corresponding controlling program in a memory to the electronically controlled circuit through a variety of processed such as controlling, operation and the like;

a memory, recording therein a controlling program for timing of changing light sources, and for receiving the control signal from said microprocessor;

an electronically controlled circuit, for receiving the controlling signal from said microprocessor, and having a function of integrating the memorized signal and outputting for driving RGB luminescent element set;

a RGB luminescent element set, provided at respective appropriate positions in the meter body for receiving the driving signal input from said electronically controlled circuit, and comprising at least red, green, blue, yellow, indigo, purple, white or mixed colors thereof;

wherein said RGB luminescent element set can be driven by means of said electronically controlled circuit in a manner of synchronized mixed lighting, and can change projected light sources of different color through the programmatically control of said microprocessor in response with the set value in the meter such that, by virtue of the changing projective light source, the user can notice various warning signals.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 2:
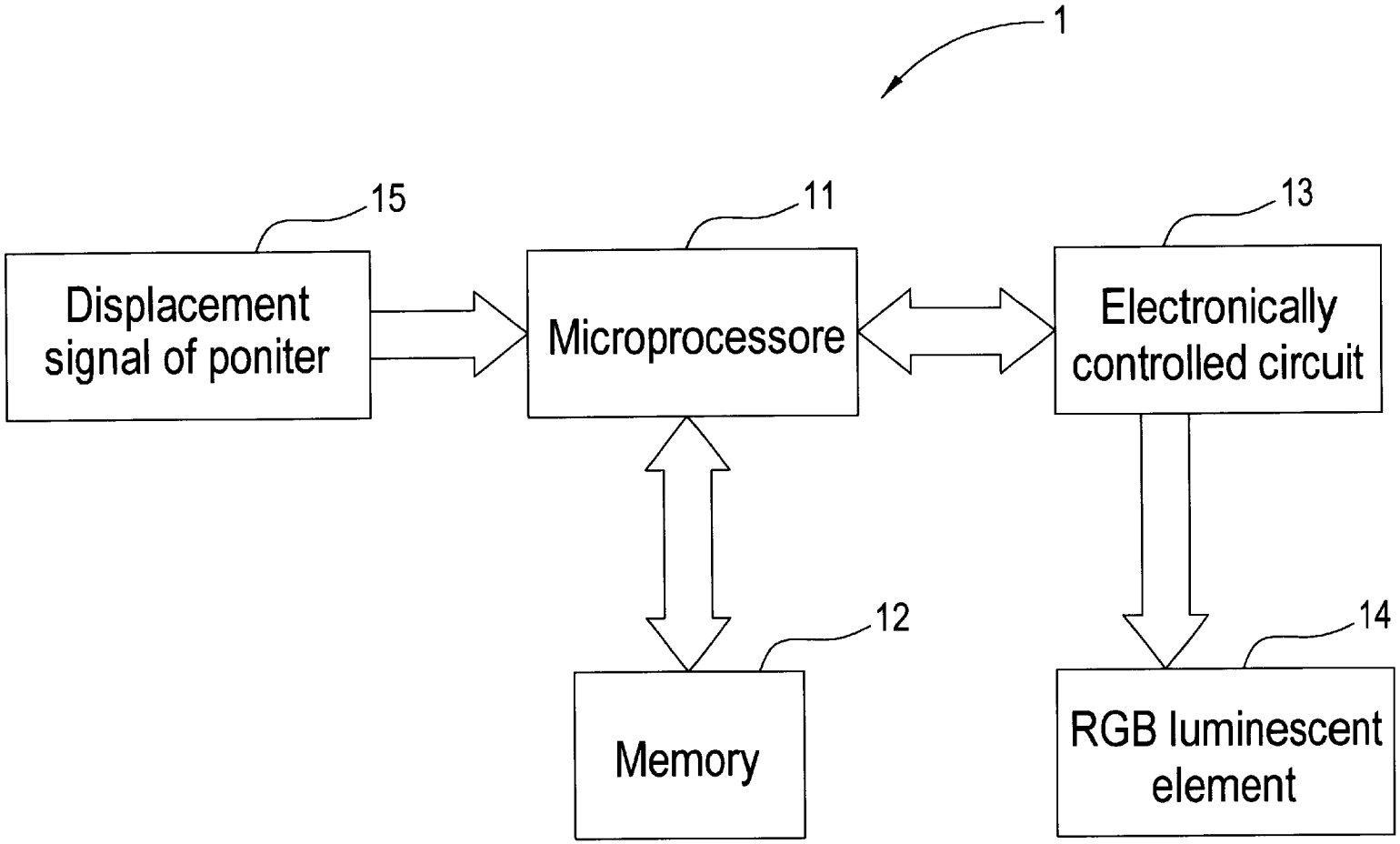
FIG. 2 is the block diagram showing the circuit in the variable light source device useful for a pointer-type meter according to the invention.

Referring to FIG. 2, a block diagram showing the circuit in the variable light source device useful for a pointer-type meter according to the invention, it is apparent that the variable light source device 1 according to the invention can be used in combination with a variety of meters, such as, for example, speed meter, tachometer, oil meter, water thermometer, oil temperature meter, oil gauge, voltmeter, and the like, and comprises essentially:

a microprocessor 11, provided between an electronically controlled circuit 13 and a memory 12 for receiving the displacement signal 15 of the pointer and for outputting the corresponding controlling program in a memory 12 to the electronically controlled circuit 13 through a variety of processed such as controlling, operation and the like;

a memory 12, recording therein a controlling program for timing of changing light sources, and for receiving the control signal from said microprocessor 11;

an electronically controlled circuit 13, for receiving the controlling signal from said microprocessor 11, and having a function of integrating the memorized signal and outputting for driving RGB luminescent element set 14;

RGB luminescent element set 14, provided at respective appropriate positions in the meter body for receiving the driving signal input from said electronically controlled circuit 13, and comprising at least red, green, blue, yellow, indigo, purple, white or mixed colors thereof;

wherein said RGB luminescent element set 14 can be driven by means of said electronically controlled circuit 13 in a manner of synchronized mixed lighting, and can change projected light sources of different color through the programmatically control of said microprocessor 11 in response with the set value in the meter such that, by virtue of the changing projective light source, the user can notice various warning signals.

Figure 1:
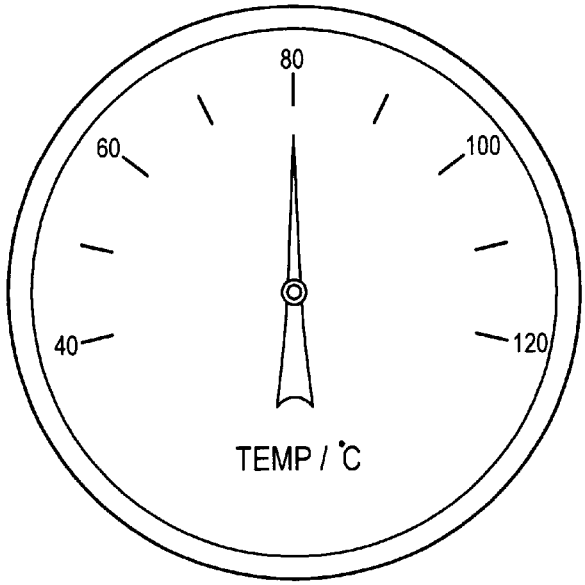
FIG. 1 is a schematic view of a conventional water thermometer.
Figure 3:
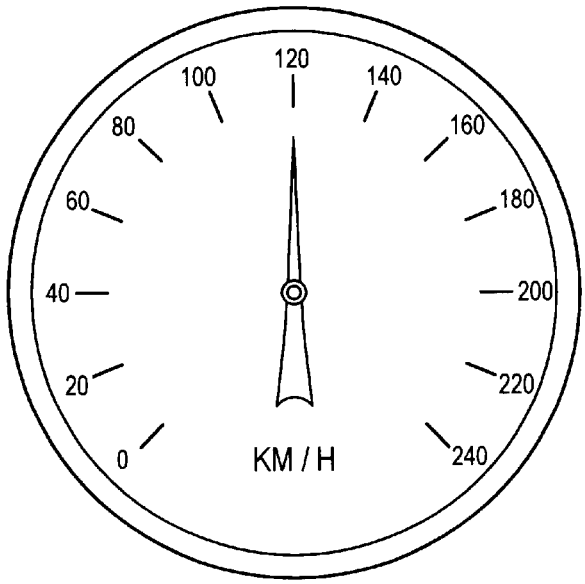
FIG. 3 shows an application example on the speed meter according to the invention.

Referring to FIG. 3, an application example on the speed meter according to the invention, it is apparent that the variable light source device is applicable on a speed meter wherein different colors can be set corresponding to different speed ranges based on the safety standard for the user. In one embodiment, the setting manner can be illustrated as follow:

| Speed (km/hr) | Color of the light source | Status of the vehicle |
|---|---|---|
| 0 | White | Rest state |
| 0~30 | Yellow | starting/low speed state |
| 30~60 | Green | Safe state in a city |
| 60~80 | Pale blue | Driving on highway |
| 80~100 | Blue | Driving on highway |
| 100~120 | Pink | High speed state |
| 120~150 | Red | Dangerous state |
| 150~ | Purple | Dangerous state |

It can be understood from the above table that, during driving, the user can see the current speed range by just noticing the change of the color of the light source, so that, as the speed is too high, speed retardation can be immediately done to avoid overdriving or risk.

Figure 4:
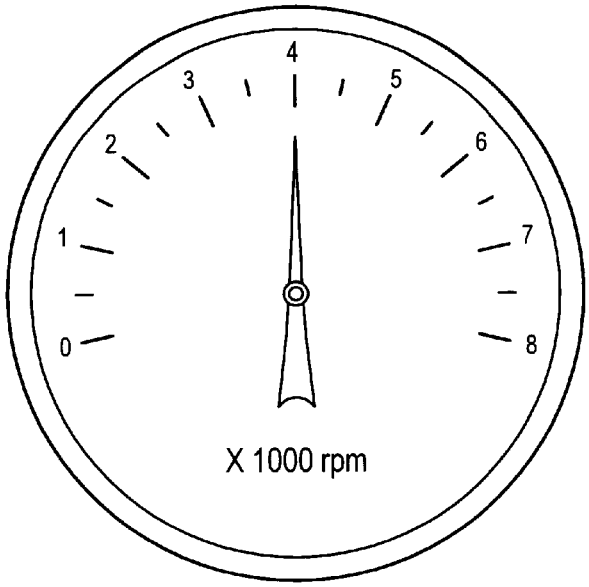
FIG. 4 shows an application example on the tachometer according to the invention.

Referring to FIG. 4, an application example on the tachometer according to the invention, it is apparent that the variable light source device is applicable on a tachometer, wherein different colors can be set corresponding to different speed ranges based on the safety standard for the user such that the user can make an optimal gear change in time.

Figure 5:
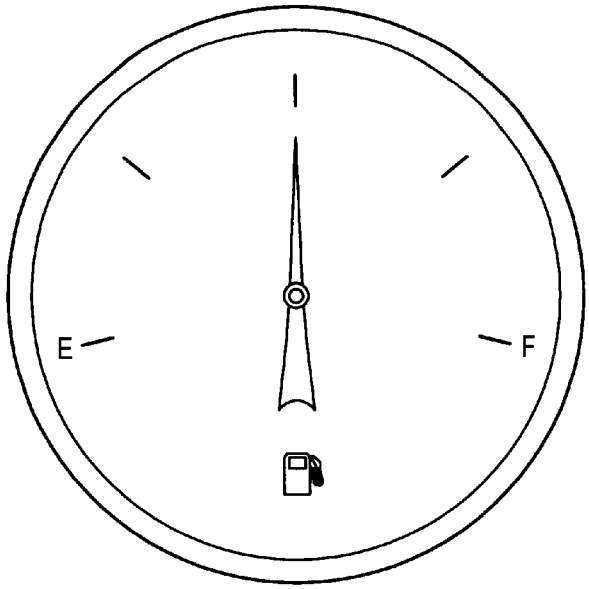
FIG. 5 shows an application example on the oil gauge according to the invention.

Referring to FIG. 5, an application example on the oil meter according to the invention, it is apparent that the variable light source device is applicable on a oil meter, wherein different colors can be set corresponding to different oil level ranges based on the oil level standard for the user such that, as the oil level lowering to a certain point, for example, down to the lowest indicator, warning indicated from a red light can notice the driver avoiding oil depletion and anchorage creek.

Figure 6:
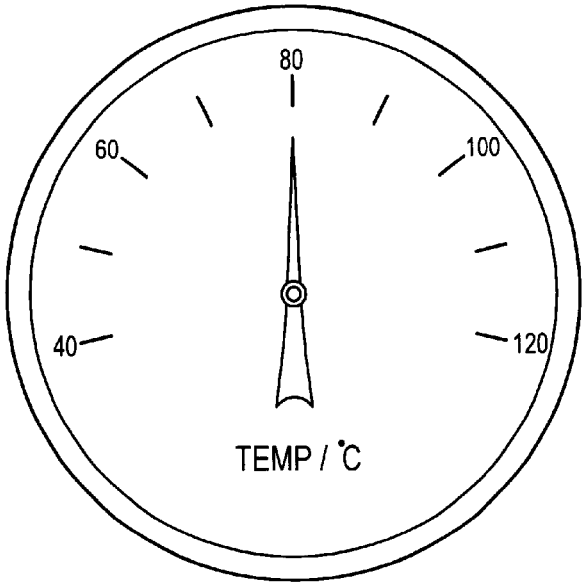
FIG. 6 shows an application example on the water thermometer according to the invention.

Referring to FIG. 6, an application example on the water thermometer according to the invention, it is apparent that the variable light source device is applicable on a water thermometer, wherein different colors can be set corresponding to different temperature ranges of the water tank based on the safety temperature standard for the water tank. In one embodiment, the setting manner can be illustrated as follow:

| Temperature (° C.) | Color of the light source | Status of the vehicle |
|---|---|---|
| 0 | White | Starting |
| 0~60 | Pale blue | Warming up |
| 60~80 | Blue | Ready to drive |
| 80~100 | Green | Normal state |
| 100~110 | Pink | State need attention |
| 110~120 | Red | Dangerous state |

It can be understood from the above table that, during driving, the user can see whether the current water temperature is in a normal state by just noticing the change of the color of the light source, so that, as the temperature is too high, stopping and adding water can be immediately done to avoid anchorage due to excessively high temperature in water tank.

Figure 7:
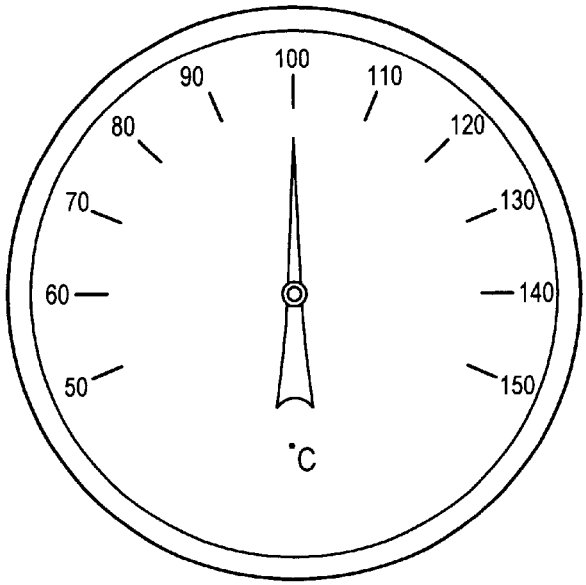
FIG. 7 shows an application example on the oil thermometer according to the invention.

Referring to FIG. 7, an application example on the oil thermometer according to the invention, it is apparent that the variable light source device is applicable on a oil thermometer, wherein different colors can be set corresponding to different oil temperature ranges based on the oil temperature standard such that, as the oil temperature is too high, warning indicated from a red light can notice the driver avoiding anchorage creek due to excessively high oil temperature.

Figure 8:
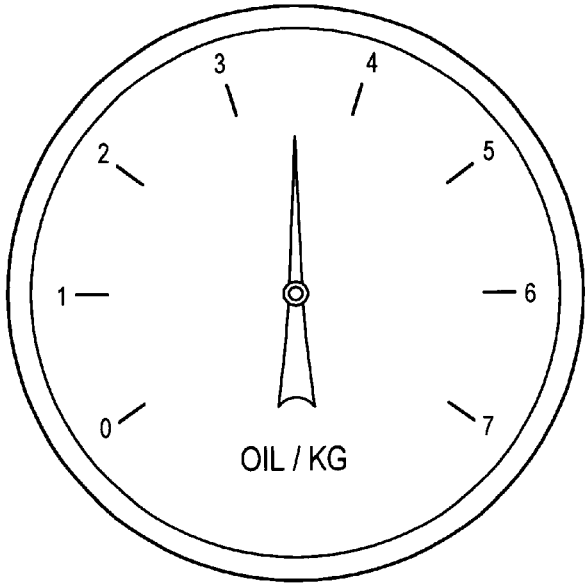
FIG. 8 shows an application example on the hydraulic meter according to the invention.

Referring to FIG. 8, an application example on the hydaulic gauge according to the invention, it is apparent that the variable light source device is applicable on a hydraulic gauge, wherein different colors can be set corresponding to different hydraulic level ranges based on the hydraulic level standard such that, as the hydraulic gauge is too low, warning indicated from a red light can notice the driver avoiding anchorage creek due to excessively low hydraulic level.

Figure 9:
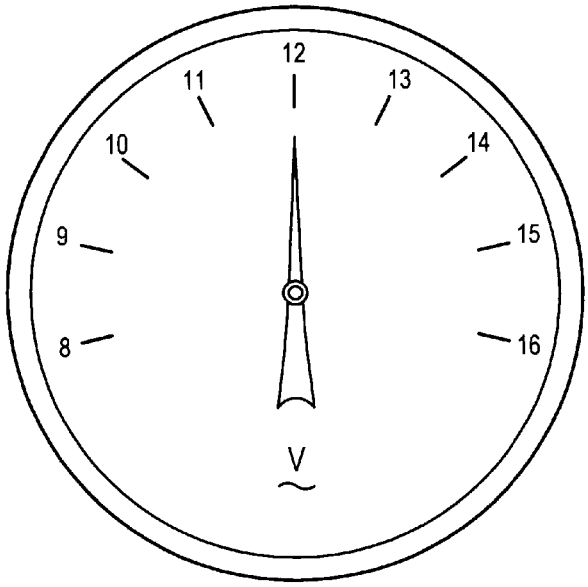
FIG. 9 shows an application example on the voltmeter according to the invention.

Referring to FIG. 9, an application example on the voltmeter according to the invention, it is apparent that the variable light source device is applicable on a voltmeter, wherein different colors can be set corresponding to different voltage ranges based on the voltage safety standard such that, as the voltage is too high or too low, warning indicated from different light can notice the driver avoiding risk due to excessively high or low voltage.

The variable light source device useful for a pointer-type meter according to the invention has several following advantages over other conventional prior art:

1. The variable light source device useful for a pointer-type meter according to the invention takes advantage of an electronically controlled circuit to drive a RGB luminescent element in a manner of synchronically mixed lighting, and by means of controlling programmatically by a microprocessor, projective light sources of different color can be changed according to the value set in the meter such that, by virtue of the changing projective light source, the user can notice immediately various warning signals to avoid dangerous event.

2. The variable light source device useful for a pointer-type meter according to the invention can be provided on various pointer-type meter such as speed meter, tachometer, oil meter, water thermometer, oil temperature meter, oil gauge, voltmeter, and the like.
3. The variable light source device useful for a pointer-type meter according to the invention has many colors for setting in accordance with different demands of the user.
4. The variable light source device useful for a pointer-type meter according to the invention is compact such that it can be provided inside and/or outside the housing of the meter as desired.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A variable light source device for a pointer-type meter, comprising:

a memory having stored therein a controlling program for timing of changing light sources;

an electronically controlled circuit for generating a driving signal for selectively driving a color luminescent element set;

the color luminescent element set being provided at respective positions in the meter body for receiving the driving signal from said electronically controlled circuit, and being selectively operable to collectively generate a plurality of colors including at least one color selected from the group consisting of: red, green, blue, yellow, indigo, purple, white or mixed colors thereof;

a microprocessor coupled to the electronically controlled circuit and the memory for receiving a displacement signal of the pointer-type meter and executing a corresponding controlling program stored in the memory to actuate the electronically controlled circuit responsive thereto;

wherein said color luminescent element set is operable responsive to said electronically controlled circuit to generate synchronized mixed lighting, whereby different colors are generated through the control of said microprocessor in response to a measured value in the meter to visually alert the user.

2. The variable light source device for a pointer-type meter as recited in claim 1, wherein said variable light source device is operably coupled to at least one pointer-type meter selected from the group consisting of: a speed meter, a tachometer, an oil meter, a water thermometer, an oil temperature meter, an oil gauge, and a voltmeter.

3. The variable light source device for a pointer-type meter as recited in claim 1, wherein said variable light source device is provided inside a housing of a meter.

4. The variable light source device for a pointer-type meter as recited in claim 1, wherein said light sources to generate at least red, green, blue, yellow, indigo, purple, white or a mixed light color thereof.

* * * * *